US006235190B1

(12) United States Patent
Bertram

(10) Patent No.: US 6,235,190 B1
(45) Date of Patent: May 22, 2001

(54) DISTILLATE PRODUCT HYDROCRACKING PROCESS

(75) Inventor: Ricky Val Bertram, Yorba Linda, CA (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/368,805

(22) Filed: Aug. 5, 1999

Related U.S. Application Data

(60) Provisional application No. 60/095,526, filed on Aug. 6, 1998.

(51) Int. Cl.[7] ..... C10G 65/00
(52) U.S. Cl. ..... 208/59; 208/58; 208/89
(58) Field of Search ..... 208/58, 59, 89

(56) References Cited

U.S. PATENT DOCUMENTS

| | | | |
|---|---|---|---|
| 3,505,208 | 4/1970 | Vaell | 208/111 |
| 5,389,595 | 2/1995 | Simpson et al. | 502/315 |

OTHER PUBLICATIONS

Nash, Richard M. "Refining/Gas Processing Technology". *Oil and Gas Journal* May 29, 1989:47–56.

Suchanek, Arthur J. "Catalytic routes to low–aromatics diesel look promising." *Oil and Gas Journal* May 7, 1990: 109–119.

Scherzer, Julius and A.J. Gruia. *Hydrocracking Science and Technology*. New York: Marcel Dekker, Inc., 1996: 174–183.

J. Scherzer,et al, pp174–, 1996.*

* cited by examiner

*Primary Examiner*—Helane Myers
(74) *Attorney, Agent, or Firm*—John G. Tolomei; John F. Spears, Jr.

(57) ABSTRACT

An integrated hydrotreating/hydrocracking process employs two hydrotreating catalysts of different relative activities in sequence to provide improved products. A more active second catalyst is employed after the first hydrotreating catalyst. The jet fuel fraction recovered from the effluent of the downstream hydrocracking reaction zone has a reduced aromatic hydrocarbon content compared to the prior art.

6 Claims, 2 Drawing Sheets

DISTILLATE PRODUCT HYDROCRACKING PROCESS

CROSS-REFERENCE TO RELATED APPLICATION

This application claims the benefit of U.S. Provisional Application No. 60/095,526, filed on Aug. 6, 1998.

FIELD OF THE INVENTION

The invention relates to a novel hydrocarbon conversion process. Specifically the invention relates to an integrated petroleum refining process comprising sequential feed hydrotreating and hydrocracking reaction zones.

RELATED ART

Hydrotreating processes are used commercially in a large number of petroleum refineries. They are used to process a variety of feeds ranging from naphthas to very heavy residual crude oil fractions. In general a hydrotreating process improves the quality of the hydrocarbonaceous feed by increasing the hydrogen to carbon ratio of the feed compounds and/or by removing sulfur and nitrogen. The significant economic utility of hydrotreating processes has resulted in a large amount of developmental effort being devoted to the improvement of these processes and to the development of highly stable and active catalysts for use in these processes.

Hydroprocessing to effect the hydrogenation of aromatic compounds boiling in the diesel fuel or kerosene boiling ranges is a well established commercial process. A study of the conditions useful in the saturation of diesel fuel aromatics, the effects of varying these conditions on product properties and other factors in using a specific commercially available hydrogenation catalyst are presented in an article at page 47 of the May 29, 1989 edition of the *Oil and Gas Journal.* A second article on the production of low aromatic hydrocarbon diesel fuel is presented at page 109 of the May 7, 1990 edition of the *Oil and Gas Journal*. These articles are incorporated herein by reference for their teaching in regard to hydrogenation practices.

U.S. Pat. No. 5,389,595 issued to H. D. Simpson et al. describes a modern hydrotreating catalyst suitable for the denitrogenation and desulfurization of a gas oil feed stream to a hydrocracking process.

The very significant economic utility of the hydrocracking process has also resulted in a large developmental effort being devoted to the improvement of the process and to the development of better catalysts for use in the process. A general review and classification of different hydrocracking process flow schemes and a description of hydrocracking catalysts is provided at pages 174–183 of the book entitled, *Hydrocracking Science and Technology* authored by Julius Scherzer and A. J. Gruia published in 1996 by Marcel Dekker, Inc. FIGS. 10.2, 10.3 and 10.5 show hydrotreating reactors upstream of the hydrocracking reactor.

U.S. Pat. No. 3,505,208 issued to R. P. Vaell describes an integrated hydrotreating/hydrocracking process. The process flow illustrates hydrotreating the feed to the two downstream hydrocracking reaction zones. The hydrotreating reactor contains two beds of hydrotreating catalyst. This reference illustrates a two-stage hydrocracking arrangement with only recycled unconverted hydrocarbons and recycle hydrogen-rich gas being charged to the second reactor.

BRIEF SUMMARY OF THE INVENTION

The subject invention is the discovery that a unique arrangement of hydrotreating catalysts in an upstream hydrotreating zone results in improved product quality for specific distillate products recovered from a downstream hydrocracking zone. Specifically, changing to a stacked configuration of hydrotreating catalysts having a more active catalyst located after a less active catalyst results in an improvement in the smoke point of the jet fuel recovered from the hydrocracking zone.

One broad embodiment of the invention may be characterized as a hydrocracking process which comprises passing hydrogen and a feed stream comprising hydrocarbonaceous compounds into a first hydrotreating zone containing a first hydrotreating catalyst and operated at hydrotreating conditions and producing a first hydrotreating zone effluent stream; passing the first hydrotreating zone effluent into a second hydrotreating zone operated at hydrotreating conditions and containing a second hydrotreating catalyst, which second hydrotreating catalyst has a relative activity at least five percent greater than the first hydrotreating catalyst; and producing a second hydrotreating zone effluent stream; passing the second hydrotreating effluent stream and additional hydrogen into a hydrocracking zone containing a hydrocracking catalyst and maintained at hydrocracking conditions, and producing a hydrocracking zone effluent stream; passing the hydrocracking zone effluent stream into a vapor-liquid separation zone which separates the entering compounds into a hydrogen rich recycle gas stream and a first liquid process stream; and, passing the first liquid process stream into a product recovery zone comprising a fractionation column, and recovering a jet fuel boiling range product distillate hydrocarbon stream from the first liquid stream.

DETAILED DESCRIPTION AND PREFERRED EMBODIMENTS

Figure 1:
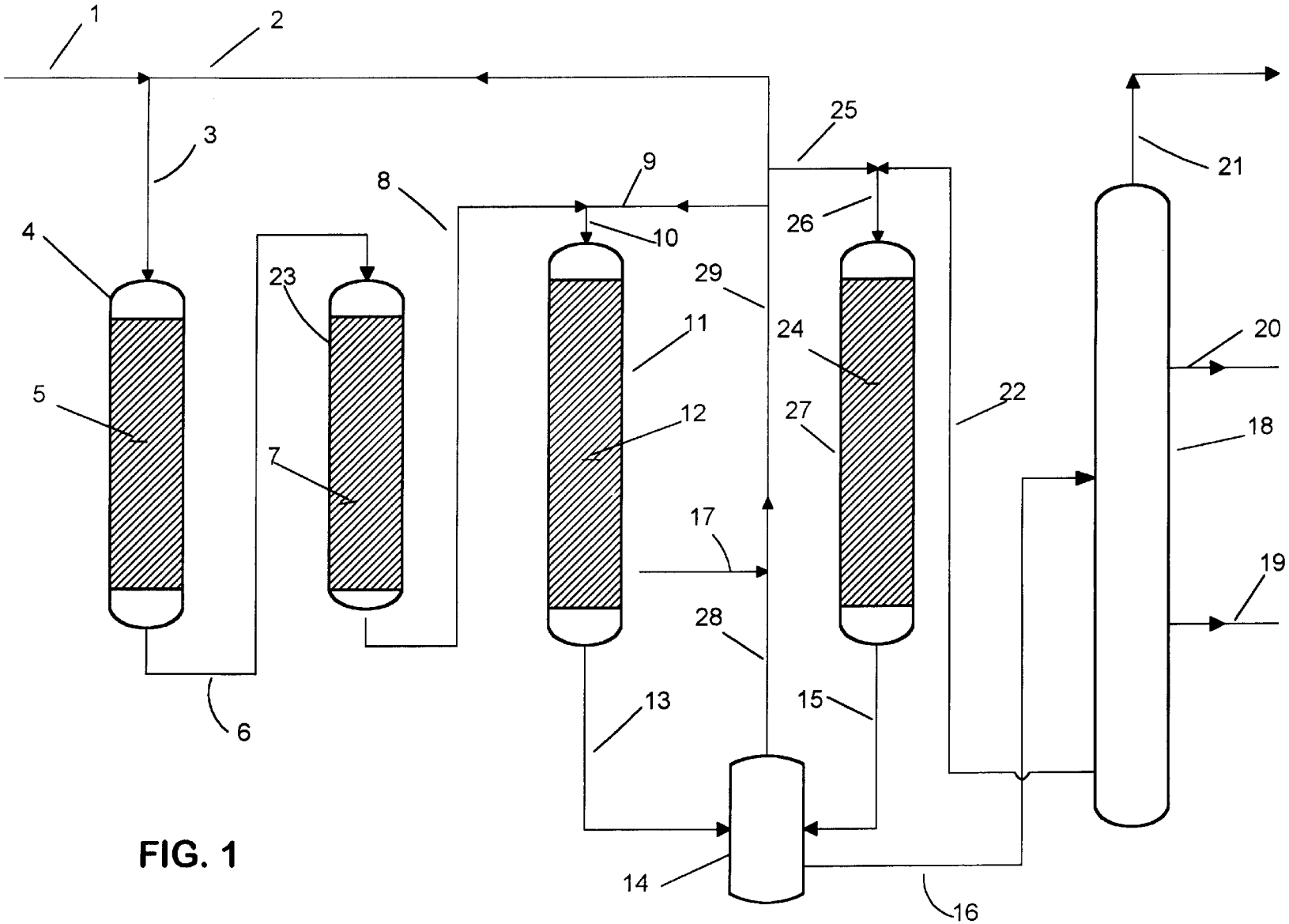
FIG. 1 is a simplified process flow diagram showing the two feed hydrotreating reactors (4,23) and two downstream hydrocracking reactors (11,27).

Much of the crude petroleum which is produced cannot be used directly as a modem fuel or petrochemical feed stock. It must be refined to remove sulfur and nitrogen which would increase air pollution if present in a fuel. It must also be refined to reduce the average molecular weight of the heavier components of the crude such that the volatility or flow characteristics of fuels are met. Finally, refining is necessary to meet quality standards for specific hydrocarbon products.

The required refining can be done in several ways. One of the more established methods employs sequential catalytic hydrotreating and catalytic hydrocracking. This is a well developed process used in a number of petroleum refineries. The subject invention relates to a change in the upstream hydrotreating step which produces an unexpected improvement in the quality of a jet fuel product recovered from a hydrocracking zone.

Typical feedstocks include virtually any heavy mineral or synthetic oil fraction having boiling points above about 400° F. (204° C.). Thus, such feedstocks as straight run gas oils, vacuum gas oils, demetallized oils, coker distillates, cat cracker distillates, and the like are contemplated. The preferred feedstock should not contain appreciable asphaltenes.

The hydrocracking feedstock may contain nitrogen, usually present as organonitrogen compounds in amounts between 1 ppm and 1.0 wt. %. The feed will normally also contain sulfur containing compounds sufficient to provide a sulfur content greater than 0.15 wt. %. It may also contain mono- and/or polynuclear aromatic compounds in amounts of 50 volume percent and higher. The compounds in the feed to the hydrotreating zone may have boiling points within the broad range extending from about 204° C. (400° F.) to about 593° C. (400° F.) and preferably within the range of from about 316° C. (600° F.) to about 550° C. (1050° F.).

In a representative example of a conventional hydrocracking process, a heavy gas oil is charged to the process and admixed with a hydrocarbon recycle stream. The resultant admixture of these two liquid phase streams is heated in an indirect heat exchange means and then combined with a hydrogen-rich gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, and other reaction by-products such as hydrogen sulfide and ammonia formed by hydrodesulfurization and hydro-denitrification reactions which occur simultaneously with the hydrocracking reaction. The reaction zone effluent will also contain the desired product hydrocarbons boiling in the gasoline, diesel fuel, kerosene and/or fuel oil boiling point ranges and some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from contact with the catalyst bed, heat exchanged with the feed to the reaction zone for heat recovery and then passed into a vapor-liquid separation zone normally including at least one high pressure separator. Additional cooling can be done prior to this separation. In some instances a hot flash separator is used upstream of the high pressure separator. The use of "cold" separators to remove condensate from vapor removed from a hot separator is another option. The liquids recovered in these vapor-liquid separation zones are passed into a product recovery zone containing one or more fractionation columns. Product recovery methods for hydrocracking are well known and conventional methods may be employed in the subject invention. In many instances the conversion achieved in the hydrocracking reactor(s) is not complete and some heavy hydrocarbons are removed from the product recovery zone as a "drag stream", and/or as the hydrocarbon recycle stream. The recycle stream is often passed into the hydrotreating reactor, if the overall process includes a hydrotreating reactor, as this normally reduces the capital cost of the overall unit It may, however, be passed directly into a hydrocracking reactor. The net drag stream is removed from the hydrocracking process. This allows the use of less severe conditions in the reaction zone(s). The size of the drag stream can be in the broad range of 1–20 volume percent of the process feed stream, but is preferably in the range of 2–10 volume percent.

In the subject process the feed stream is first subjected to a hydrotreating step. This has traditionally been practiced as a means of removing sulfur and nitrogen from the feedstock in order to prepare it for the downstream hydrocracking reactors. One reason for this is that a lower sulfur or nitrogen content may increase the observed activity of the hydrocracking catalyst. The hydrotreating zone is a treating zone rather than conversion or cracking zone. The effluent from the hydrotreating zone will preferably comprise an admixture of hydrocarbons having essentially the same boiling point range as the feed which enters the hydrotreating zone. Only a small amount, preferably less than 10%, conversion by cracking occurs in the hydrotreating zone. The conversion which does occur will produce some lower boiling hydrocarbons but the majority of the feed preferably passes through the hydrotreating zone with only a minor boiling point change. Therefore it is the effluent of the second zone which is fractionated to yield the final product distillate streams. Most preferably less than 5% conversion occurs in the hydrotreating zone. Conversion is normally undesired in a hydrotreating process as it reduces the yield of the intended middle distillate products. The term "conversion" as used herein refers to the chemical change necessary to convert feed stream molecules into product hydrocarbons which become part of a distillate product recovered from the effluent of the respective reaction zone.

The benefit of the subject invention was discovered following analysis of data from a commercially operated integrated hydrotreating/hydrocracking unit having a design similar to that of FIG. 1. This unit had been previously operated with the same hydrotreating catalyst loaded into both the first and second hydrotreating reactors. In a subsequent run, a more active hydrotreating catalyst was loaded into the second reactor in an effort to increase the useful life of the hydrotreating catalyst. This novel "stacked" hydrotreating catalyst loading resulted in an increase in useful life of the hydrotreating catalyst. However, it was also found to provide a substantial and unexpected improvement in the quality of the middle distillate product of the downstream hydrocracking unit. Specifically the novel loading significantly reduced the aromatics content and improved the smoke point of the jet fuel boiling range hydrocarbons formed by cracking the hydrotreating zone product. The smoke point is one of the primary factors used in measuring the quality of the jet fuel and therefore the quality of this important product was increased.

The subject invention comprises increasing the average activity of the total hydrotreating catalyst employed in the overall process and therefore would not encompass a change to a different initial hydrotreating catalyst having a lower activity. This may be summarized as saying the activity of the downstream catalyst is increased. The invention therefore does not relate to catalyst changes made to take advantage of catalysts having better demetallization, stability or other qualities.

The overall invention is shown on FIG. 1. Referring now to this figure, a charge stream enters the process through line 1 and is admixed with the recycle hydrogen stream from line 2. The admixture of these two streams is passed through a heating means not shown via line 3 and then into the first hydrotreating reactor 4. The hydrotreating reactor 4 will typically contain two or more separate beds of hydrotreating catalyst. The beds are separated by a support means which may include vapor and liquid redistribution devices and/or means to admix quench hydrogen added between the beds of catalyst. The contacting performed in the first reactor 4 results in the conversion of sulfur in the organic hydrocarbonaceous compounds into hydrogen sulfide and the conversion of nitrogen in these feed compounds into ammonia.

There is thereby formed a mixed phase effluent stream removed from the first reactor 4 via line 6 and passed into a second reactor 23. The mixed phase effluent stream will comprise some unconverted initial feed compounds, the remaining unconsumed hydrogen and by-products of the hydrotreating performed in the first reactor including hydrocarbon by-products, ammonia and hydrogen sulfide. This broad admixture is passed into the upper end of the second hydrotreating reactor 23 and passed downward through a second more active catalyst 7. Similar to the first reactor, the catalyst in the second reactor is normally and preferably present in several smaller subbeds within the overall reactor vessel. The catalyst and operating conditions in the two reactors 4 and 23 are chosen and adjusted with care to result in effective removal of the required amount of sulfur and nitrogen from the hydrocarbonaceous feed molecules in order to obtain desired results in the downstream hydrocracking reactors.

The effluent of the second reactor is withdrawn through line 8 and admixed with an additional portion of a hydrogen-rich recycle gas stream carried by line 9. The recycle gas stream will contain other compounds including some hydrogen sulfide and light hydrocarbons such as methane, ethane and butane. The admixture of feed hydrocarbons, hydrogen and by-products is passed into the inlet at the upper end of the hydrocracking reactor 11 via line 10. The reactants are thereby brought into contact with the hydrocracking catalyst 12. The hydrocracking catalyst is preferably divided into three or more separate beds within the reactor 11. Due to the exothermic nature of the hydrocracking reactions, the temperature of the reactants increases as they pass through each of the catalyst beds. It is therefore customary to add recycle hydrogen through lines not shown at intermediate points between the beds to slightly quench the temperature of the reactants. This contacting of the feed compounds with the hydrocracking catalyst at hydrocracking conditions will result in the conversion of a significant fraction of the entering feed compounds into smaller (lighter) molecules of reduced average molecular weight. There is thereby formed a hydrocracking reaction zone effluent stream carried by line 13 and comprising an admixture of unconverted feed compounds, reaction byproducts, intended process products, hydrogen and light gases.

The effluent stream of the first hydrocracking reactor 11 is passed via line 13 into a vapor-liquid separation zone 14. The effluent of the first hydrocracking zone could be cooled by indirect heat exchange if desired. This could be, for instance, for purposes of heat recovery as to raise the temperature of the process feed stream to the desired inlet temperature of the hydrotreating reactor 4. The design and conditions maintained in the vapor-liquid separator are judiciously chosen to result in the separation of the entering compounds into a liquid stream withdrawn through line 16 comprising substantially all of the unconverted feed and product hydrocarbons and a hydrogen-rich vapor stream removed through line 28. The recycle stream will comprise substantially all of the vapor phase hydrogen charged to the separator plus some light hydrocarbons and hydrogen sulfide. The recycle gas is compressed by a recycle compressor not shown and then augmented by a stream of makeup hydrogen from line 17. The stream of recycle hydrogen then continues through line 29 for dispersal between the different reactors of the process.

The liquid phase materials collected in the separator 14 are transported through line 16 into a product recovery zone represented by the fractionation column 18. Normally the product recovery zone will include one or more additional vapor-liquid separation vessels, a light ends stripping column such as a debutanizer plus a product fractionator. For ease of presentation, the subject Drawing only illustrates the single column 18. The hydrocarbons flowing into the column 18 are separated into several distillate products represented by an overhead stream removed through line 21 of naphtha boiling range hydrocarbons, a product stream removed through line 20 representing the jet fuel or kerosene boiling range products and a third product stream removed through line 19 as the diesel fuel boiling range product. The remaining portion of the hydrocarbons fed to the product recovery zone are separated into a relatively small optional dragstream removed from the bottom of the column by means not shown and a much larger recycle stream removed as a sidecut and passed into the second hydrocracking reaction zone 27 through line 22. Prior to passage into the second hydrocracking reaction zone 27, the recycled hydrocarbons are admixed with recycle hydrogen-rich gas from line 25 and then passed through line 26 into the reactor. As in the other four reaction zones employed in the subject process, the second hydrocracking reaction zone 27 preferably comprises several separate beds of catalyst. It also preferably has means provided for the interstage addition of quench hydrogen. The catalyst 24 employed in the second reaction zone 27, which is also referred to as the second stage hydrocracking zone, may be the same or different than the hydrocracking catalyst employed in the first stage zone 11. The preference for a different catalyst may be based upon the different characteristics of the unconverted hydrocarbons which are fed to this reactor plus the differing concentration of hydrogen sulfide and ammonia in the reactor. The contacting performed in the second reaction zone results in additional conversion of the feed hydrocarbons and the production of additional distillate products. There is thereby formed a second hydrocracking zone effluent stream removed through line 15 and passed into the vapor-liquid separation zone 14.

Figure 2:
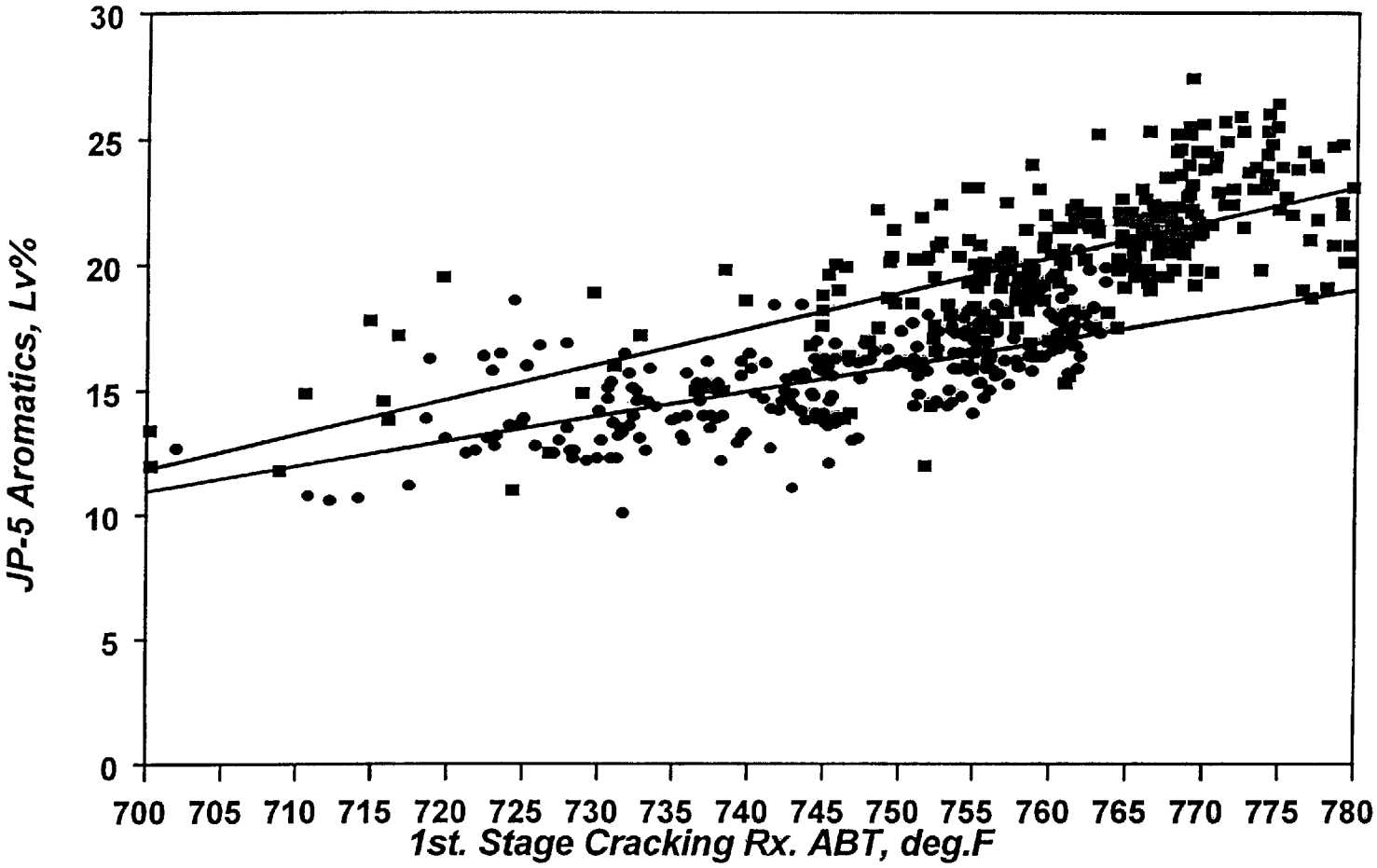
FIG. 2 is a chart showing the aromatics content of the jet fuel product of the hydrocracking reactors plotted against the effluent temperature of the first hydrocracking reactor for both the prior art and subject process.

FIG. 2 is a plot of the aromatics content of a JP-5 grade jet fuel recovered from the product fractionation column versus the ABT (average bed temperature) of the first reaction zone. The squares on the plot represent data from the immediately preceding operation of a commercial unit having a flow scheme as described in FIG. 1. The lower band of circular dots represents data collected during the operation of this unit with the same feed and hydrocracking catalyst but with a more active hydrotreating catalyst loaded in the second hydrotreating reactor in accordance with the invention. The significant reduction in the aromatics content of the jet fuel is clearly illustrated by the two regression lines for the respective operations shown on the figure.

The subject process employs two different hydrotreating catalysts. The important difference in these catalysts is their relative activity. The process feed stream is passed through the two catalysts in series, with the second catalyst having a higher hydrotreating activity. The second catalyst is at least 5 percent more active than the first catalyst, and preferably is more than 10 percent more active than the first catalyst. As used herein, the term activity is intended to refer to hydrotreating performance determined by processing a test feed at standard operating conditions of temperature, space velocity and hydrogen flow rate and observing the comparative reduction in the sulfur and nitrogen content of the products. This difference is used to calculate the kinetic rate constant of the catalyst. Assuming this is a first order constant, the difference in activity is expressed in terms of differences in the calculated rate constant. A suitable test to measure the activity would employ a gas oil doped with or naturally containing a desired amount of sulfur and nitrogen containing compounds. This feed is processed using a presulfided catalyst at a constant temperature such as 720° F. (382° C.) at a liquid hourly space velocity of 1.0 $hr^{-1}$, total pressure of 1450 psig (9998 kPa) and a hydrogen to hydrocarbon flow rate of 6,000 std $ft^2$/bbl (1066 std $m^3/m^3$). Such tests are routinely employed by catalyst manufacturers and others to compare relative catalyst activity.

The more active catalyst should comprise at least 30 wt. percent of the hydrotreating catalyst. The amount of the more active hydrotreating catalyst employed in the process is limited to between about 30 to about 75, preferably 30 to 55, wt. percent of the total hydrotreating catalyst used in the process to pretreat the feed to the hydrocracking portion of the process.

The subject process employs two different types of catalyst, hydrotreating catalyst and hydrocracking catalyst. These two types of catalysts normally share many similarities. For instance, they may have relatively similar particle shape and size. Both normally comprise an inorganic support material and at least one hydrogenation metal. The two types of catalysts will, however, also differ significantly since each has been tailored to perform a different function. One of the most obvious differences is that the hydrocracking catalyst will also comprise one or more acidic cracking components, such as silica-alumina and/or Y-zeolite. The two types of catalysts are also expected to differ in other ways such as in terms of the metals employed as the hydrogenation component, the particle's pore volume distributions and density, etc. Suitable catalysts for use in all reaction zones of this process are available commercially from several vendors including UOP, Haldor-Topsoe and Criterion Catalyst Company.

Hydrotreating catalysts typically do not contain zeolitic materials or molecular sieve materials and often comprise only one or more metals on an amorphous alumina. Much of the art and technology involved with the hydrogenation components of the catalyst is centered upon the identity and amount of the metals in the catalyst, the methods chosen for the impregnation of the metals into the catalyst, the pore structure and distribution of the alumina and the overall geometry of the catalyst particle.

Both the hydrocracking and hydrotreating catalyst will typically comprise a base metal hydrogenation component chosen from nickel, cobalt, molybdenum and tungsten and possibly promoters such as phosphorous supported on an inorganic oxide catalyst. The hydrogenation metals are usually a Group VIB and/or a Group VIII metal component, with each metal being present at a concentration based upon the finished catalyst equal to about to 2 to about 18 wt. % measured as the common metal oxide. The catalysts are preferably essential free of any platinum-group metal including platinum, palladium, rhodium, osmium, and iridium due to the higher costs of these metals. However, they could be employed in the second catalyst if desired as they tend to have higher hydrogenation activities. A platinum group metal is preferably present at a lower concentration of about 0.1 to 1.5 wt. %. If used phosphorus is normally present in the catalyst in the range of 1 to 30 wt. % and preferably 3 to 15 wt. % calculated as $P_2O_5$. A preferred form of the catalyst is an extrudate having a symmetrical cross-sectional shape, which is preferably a cylindrical or polylobal shape. The cross-sectional diameter of the particles is usually from about 1/40 to about 1/8 inch and preferably about 1/32 to about 1/12 inch. A quadralobal cross-sectional shape resembling that of a four leaf clover is shown in U.S. Pat. No. 4,028,227. Other shapes which may be employed in the catalyst are described in this patent and in U.S. Pat. No. 4,510,261. These patents are incorporated herein for their teaching as to potential particle shapes which may be employed for both catalysts employed in the subject invention.

The preferred high activity hydrotreating catalyst comprises a hydrogenation component comprising nickel and molybdenum on an extruded porous support of phosphorous containing alumina. Details on the production of hydrotreating catalysts containing these four components are provided in U.S. Pat. Nos. 4,738,944; 4,818,743 and 5,389,595 which are incorporated herein for this teaching.

Hydrogenation components may be added to the catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles.

The total pore volume of both the hydrotreating and hydrocracking catalysts should be within the broad range of about 0.2 to about 1.0 cc per gram and preferably between about 0.25 to about 0.7 cc per gram. The finished catalyst should have a surface area greater than about 100 meters per gram and preferably between about 100 and 300 meters per gram as measured by mercury porosity. The finished catalysts for utilization in the subject process should have a surface area of about 200 to 700 square meters per gram, an average pore diameter of about 20 to about 300 Angstroms, and apparent bulk density within the range of from about 0.50 to about 0.90 gram/cc. Surface areas above 350 $m^2/g$ are greatly preferred.

Both the hydrotreating and hydrocracking catalysts preferably comprise a support material which is highly porous, uniform in composition and relatively refractory to the conditions utilized in the hydrocarbon conversion process. The term "uniform in composition" denotes a support which is unlayered, has no concentration gradients of the species inherent to its composition, and is completely homogeneous in composition to the extent feasible in mass production. Thus, if the support is a mixture of two or more refractory materials, the relative amounts of these materials will be constant and uniform throughout the entire support. The catalyst may comprise a variety of support materials which have traditionally been utilized in hydrocarbon conversion catalysts such as refractory inorganic oxides including alumina, titanium dioxide, zirconium dioxide, chromium oxide, zinc oxide, magnesia, thoria, boria, silica-alumina, silica-magnesia, chromia-alumina, alumina-boria, silica-zirconia, etc.; and, silica or silica gel, clays and silicates including those synthetically prepared and naturally occurring, which may or may not be acid treated, for example attapulgus clay, diatomaceous earth, fuller's earth, kaolin, kieselguhr, etc. The preferred support material for the hydrotreating catalyst is alumina. Suitable aluminas are the crystalline aluminas known as the gamma-, eta-, and thetaaluminas. Excellent results are obtained with a matrix of substantially pure gamma-alumina.

An alumina component of either of the two catalysts used in the process may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The composition and physical characteristics of the catalysts such as shape and surface area are not considered to be limiting upon the utilization of the present invention. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of a fluidized or ebulated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The reaction zones therefore do not need to be fixed bed systems as depicted on the Drawing.

The catalyst particles may be prepared by any known method in the art including the well-known oil drop and extrusion methods. A preferred form for the catalysts used in the subject process is an extrudate. The well-known extrusion method involves mixing the molecular sieve, either before or after adding metallic components, with the binder and a suitable peptizing agent to form a homogeneous dough or thick paste having the correct moisture content to allow for the formation of extrudates with acceptable integrity to withstand further handling and subsequent calcination. Extrudability is determined from an analysis of the moisture content of the dough, with a moisture content in the range of from 30 to 50 wt. % being preferred. The dough is extruded through a die pierced with multiple holes and the spaghetti-shaped extrudate is cut to form particles in accordance with techniques well known in the art A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form, such as spheres, by any means known to the art.

A spherical catalyst for use in either the hydrotreating section or the hydrocracking section of the process may be formed by use of the oil dropping technique such as described in U.S. Pat. Nos. 2,620,314; 3,096,295; 3,496,115 and 3,943,070 which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an anmoniacal solution to further improve their physical characteristics. The resulting aged and gelled particles are then washed and dried at a relatively low temperature of about 50–200° C. and subjected to a calcination procedure at a temperature of about 450–700° C. for a period of about 1 to about 20 hours. This treatment effects conversion of the hydrogel to the corresponding alumina matrix. Zeolite and silica-alumina must be admixed into the aluminum containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

It is preferred that the hydrocracking catalyst comprises between 1 wt. % and 90 wt. % Y zeolite, preferably between 10 wt. % and 80 wt. %. The zeolitic catalyst composition should also comprise a porous refractory inorganic oxide support (matrix) which may form between about 10 and 99 wt. %, and preferably between 20 and 90 wt. % of the support of the finished catalyst composite. The matrix may comprise any known porous refractory inorganic oxide such as alumina, magnesia, silica, titania, zirconia, silica-alumina and the like and preferably comprises a combination thereof such as alumina and silica-alumina. The most preferred matrix comprises a mixture of silica-alumina and alumina wherein the silica-alumina comprises between 15 and 85 wt. % of said matrix. It is also preferred that the support comprises from about 5 wt. % to about 45 wt. % alumina.

A Y zeolite has the essential X-ray powder diffraction pattern set forth in U.S. Pat. No. 3,130,007. The as synthesized zeolite may be modified by techniques known in the art which provide a desired form of the zeolite. Thus, modification techniques such as hydrothermal treatment at increased temperatures, calcination, washing with aqueous acidic solutions, ammonia exchange, impregnation, or reaction with an acidity strength inhibiting specie, and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. The Y zeolites produced by UOP of Des Plaines, Ill. under the trademarks Y-82, Y-84, LZ-10 and LZ-20 are suitable zeolitic starting materials. These zeolites have been described in the patent literature. It is contemplated that other zeolites, such as Beta, Omega, L or ZSM-5, could be employed as the zeolitic component of the hydrocracking catalyst in place of or in addition to the preferred Y zeolite.

Hydrocarbons removed from the bottom of the product recovery column as a drag stream may be a high value product but are not considered to be either distillates or conversion products for purposes of this definition of conversion. The desired "distillate" products of a hydrocracking process are normally recovered as sidecuts of a product fractionation column and include the naphtha, kerosene and diesel fractions. The product distribution of the subject process is set by the feed composition and the selectivity of the catalyst(s) at the conversion rate obtained in the reaction zones at the chosen operating conditions.

It is therefore subject to considerable variation. The subject process is especially useful in the production of middle distillate fractions boiling in the range of about 300–700° F. (149–371° C.) as determined by the appropriate ASTM test procedure. The term "middle distillate" is intended to include the diesel, jet fuel and kerosene boiling range fractions. The terms "kerosene" and "jet fuel boiling point range" are intended to refer to about 300–550° F. (149–288° C.) and diesel boiling range is intended to refer to hydrocarbon boiling points of about 338—about 700° F. (170–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary with such factors as the characteristics of the crude oil source, the refinery's local markets, product prices, etc. Reference is made to ASTM standards D975 and D-3699-83 for further details on kerosene and diesel fuel properties and to D-1655 for aviation turbine feed. These definitions provide for the inherent variation in feeds and desired products which exists between different refineries. Typically, this definition will require the production of distillate hydrocarbons having boiling points below about 700° F. (371° C.).

While the hydrotreating zones are maintained at hydrotreating conditions and the hydrocracking zone(s) are kept at hydrocracking conditions, these conditions may be somewhat similar. The pressure maintained in both the hydrotreating and hydrocracking reaction zones should be within the broad range of about 400 to 2500 psia (2758–17, 238 kpa). It is preferred to employ a pressure above 1500 psia (10,343 kPa) in the hydrocracking zone. The reaction zones are preferably operated with a hydrogen to hydrocarbon ratio of about 5,000 to 18,000 standard cubic feet of hydrogen per barrel of feedstock (889 to 3200 standard $meter^3$ per $meter^3$). The hydrotreating zones may be operated at an inlet temperature of about 450 to 670 degrees F. (232–354 degrees C.). The hydrocracking zones may be operated with an inlet temperature of 640–800° F. (338–426° C.). In the subject process the reaction zones are operated at conditions which include liquid hourly space velocities of from about 0.2 to 10 $hr^{-1}$, and preferably about 1.0 to about 2.5 $hr^{-1}$.

What is claimed is:

1. A hydrocracking process which comprises:

a.) passing hydrogen and a feed stream comprising hydrocarbonaceous compounds into a first hydrotreating zone containing a first hydrotreating catalyst and operated at hydrotreating conditions and producing a first hydrotreating zone effluent stream;

b.) passing the first hydrotreating zone effluent stream into a second hydrotreating zone operated at hydrotreating conditions and containing a second hydrotreating catalyst, which second hydrotreating catalyst has a relative activity at least five percent greater than the first hydrotreating catalyst; and producing a second hydrotreating zone effluent stream;

c.) passing the second hydrotreating zone effluent stream and additional hydrogen into a hydrocracking zone containing a hydrocracking catalyst and maintained at hydrocracking conditions, and producing a hydrocracking zone effluent stream;

d.) passing the hydrocracking zone effluent stream into a vapor-liquid separation zone which separates the entering compounds into a hydrogen rich recycle gas stream and a first liquid process stream; and, e.) passing the first liquid process stream into a product recovery zone comprising a fractionation column, and recovering a jet fuel boiling range product distillate hydrocarbon stream from the first liquid stream.

2. The process of claim 1 wherein the second hydrotreating zone contains at least 30 wt. percent of the hydrotreating catalyst used in the process.

3. The process of claim 1 wherein the relative activity of the second hydrotreating catalyst is at least 10 percent greater than that of the first hydrotreating catalyst.

4. A hydrocracking process which comprises:

a.) passing hydrogen and a feed stream comprising hydrocarbonaceous compounds boiling in the gas oil boil range into a first hydrotreating zone containing a first hydrotreating catalyst and operated at hydrotreating conditions and producing a first hydrotreating zone effluent stream;

b.) passing the entire first hydrotreating zone effluent stream into a second hydrotreating zone operated at hydrotreating conditions and containing a second hydrotreating catalyst, which second hydrotreating catalyst has a relative activity at least five percent greater than the first hydrotreating catalyst and with the second hydrotreating zone containing from about 30 to about 75 wt. percent of the hydrotreating catalyst employed in the process; and producing a second hydrotreating zone effluent stream;

c.) passing the second hydrotreating zone effluent stream and additional hydrogen into a first hydrocracking zone containing a hydrocracking catalyst and maintained at hydrocracking conditions, and producing a first hydrocracking zone effluent stream;

d.) passing the first hydrocracking zone effluent stream into a vapor-liquid separation zone which separates the entering compounds into a hydrogen rich recycle gas stream and a first liquid process stream;

e.) passing the first liquid process stream into a product recovery zone comprising a fractionation column, and recovering from the first liquid stream a jet fuel boiling range product distillate hydrocarbon stream and a recycle hydrocarbon stream comprising hydrocarbons boiling above the jet fuel boiling point range;

f.) passing the recycle hydrocarbon stream and hydrogen into a second hydrocracking zone operated at hydrocracking conditions and containing a hydrocracking catalyst, and producing a second hydrocracking reaction zone effluent stream; and, g.) passing the second hydrocracking zone effluent stream into the vapor-liquid separation zone.

5. The process of claim 4 wherein the relative activity of the second hydrotreating catalyst is at least 10 percent greater than that of the first hydrotreating catalyst.

6. The process of claim 4 wherein the second hydrotreating zone contains from about 30 to about 55 wt. percent of the total hydrotreating catalyst employed in the process.

* * * * *